US007815336B2

(12) United States Patent
Au et al.

(10) Patent No.: US 7,815,336 B2
(45) **Date of Patent: *Oct. 19, 2010**

(54) FLASHLIGHT

(75) Inventors: Kang Woon Au, Kowloon (HK); Siu Bong Ng, Sha Tin (HK); Wing On Tang, Hong Kong (HK)

(73) Assignee: Eveready Battery Company, Inc., St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/357,705

(22) Filed: Jan. 22, 2009

(65) Prior Publication Data

US 2009/0122529 A1 May 14, 2009

Related U.S. Application Data

(63) Continuation of application No. 11/926,169, filed on Oct. 29, 2007, now Pat. No. 7,510,298.

(51) Int. Cl.
*F21L 4/04* (2006.01)

(52) U.S. Cl. ..... 362/188; 362/202; 362/285; 362/418

(58) Field of Classification Search ..... 362/187–189, 362/202–206, 197–199, 191, 200, 208, 285, 362/287–289, 418, 429, 430, 449, 109–120
See application file for complete search history.

(56) References Cited

U.S. PATENT DOCUMENTS

| | | | | |
|---|---|---|---|---|
| 1,408,528 | A | 3/1922 | Lyhne | |
| 1,584,539 | A | 5/1926 | Hopkins | |
| 1,820,620 | A | 8/1931 | Jones | |
| 2,125,038 | A | 7/1938 | Tompkins et al. | |
| 2,444,107 | A | 6/1948 | Montgomery | |
| 3,603,783 | A | 9/1971 | Schwartz | |
| 4,307,439 | A | 12/1981 | Sassmannshausen | |
| 4,527,223 | A | 7/1985 | Maglica | |
| 5,461,552 | A * | 10/1995 | Tillery | 362/188 |
| 6,045,236 | A | 4/2000 | Cheng et al. | |
| 6,068,386 | A | 5/2000 | Pastega | |
| 6,174,071 | B1 | 1/2001 | Chan | |
| 6,257,734 | B1 | 7/2001 | Tchira | |
| 7,001,042 | B2 | 2/2006 | Maglica | |
| 7,309,139 | B2 | 12/2007 | Au et al. | |
| 7,510,298 | B2 * | 3/2009 | Au et al. | 362/188 |

FOREIGN PATENT DOCUMENTS

| | | | |
|---|---|---|---|
| FR | 2444885 | A | 8/1980 |
| WO | 02/066887 | A1 | 8/2002 |

* cited by examiner

*Primary Examiner*—Bao Q Truong
(74) *Attorney, Agent, or Firm*—Gregory J. Adams

(57) ABSTRACT

A portable lighting device, such as a flashlight, having a rotatable band disposed around the exterior of the flashlight is disclosed. Rotational movement of the band is converted to lateral movement of the light emitting element within the flashlight. The structural integrity of the flashlight is not compromised when the rotatable band is rotated around the flashlight to adjust the width of the projected pattern of light.

20 Claims, 7 Drawing Sheets

FLASHLIGHT

BACKGROUND OF THE INVENTION

This invention generally relates to flashlights. More particularly, this invention is concerned with flashlights that have a focusing mechanism incorporated therein.

Portable lighting devices, such as flashlights and lanterns, are commercially available in a wide array of embodiments. Some embodiments, such as tubularly shaped flashlights, are required to produce a narrow pattern of light that brightly illuminates a small area that must be closely inspected as well as a broad, less intense pattern of light that illuminates a much larger area. Some flashlights include a mechanism that can be used to change the pattern of light from broad to narrow and from narrow to broad as needed and are commonly known as "focusable lights". Many commercially available focusable lights adjust the size of the projected light beam by rotating the lens cap which is threaded onto one end of the flashlight's housing. The lens cap typically contains the transparent lens through which the light is projected as well as the reflector which directs the light through the lens. As the lens cap is rotated in a first direction around the flashlight's housing, the reflector is moved relative to the light and the lens cap is loosened from the flashlight's housing. Moving the reflector in relation to the light causes the width of the projected light pattern to change. Unfortunately, loosening the lens cap can be detrimental to the operation of the light as well as the safety of the person using the light. For example, a problem can occur if a consumer accidentally removes the lens cap from the flashlight's housing while trying to adjust the focus of the light. If the consumer is in a dark location when the focus of the light must be adjusted and the lens cap is unintentionally and unexpectedly separated from the remaining portion of the housing, the user may drop one or more of the light's components and thus not be able to properly reassemble the batteries and/or components thereby precluding further use of the flashlight. If the unintended disassembly occurs in an environment containing flammable fumes, such as could occur in an underground mine, the light bulb's filament could ignite the fumes if the bulb's glass envelop were broken and its hot filament then contacted the fumes. Another problem can occur if the flashlight is used in an environment where the flashlight may be unintentionally sprayed with water such as when the light is used by a firefighter during the act of extinguishing a fire. Some of the water could flow between the lens cap and the flashlight's housing because the connection between these components had been loosened in order to focus the light. If water accumulates in the portion of the flashlight's housing that contains the batteries, switch and light bulb, the flashlight's performance may deteriorate due to rusting of the battery's terminals or the creation of an electrical short circuit in the switch. Either problem can lead to premature failure of the light. Yet another problem with flashlights that require the consumer to loosen the lens ring in order to adjust the focus of the light is the tendency of the light not to remain at the focused position for an extended period of time because the lens cap and flashlight housing are loosely secured to one another. For example, the lens ring may rotate, relative to the flashlight housing, as the flashlight rolls across a surface or is repeatedly inserted into and removed from a tool pouch. If the focus of the light is accidentally changed, the user must readjust the light's focusing mechanism to achieve the desired light pattern before proceeding with the task at hand.

The present invention provides a flashlight with a focusing mechanism that can be safely used in environments where the flashlight's housing must prevent accidental disassembly and the flashlight's light pattern must be adjustable by the user. The mechanism allows the user to set the focus as needed and then use the light as desired without the flashlight's light pattern inadvertently changing due to a loose connection between the flashlight's components.

In one embodiment, a portable lighting device of the present invention includes a housing, a reflector, a light emitting element and a focusing mechanism. The housing has a first section removably secured to a second section. The first section defines an opening having a light transparent material disposed there across. The second section defines an open ended cavity having at least one battery disposed therein. The first section and the second section define an enclosed cavity. The reflector is securely disposed within the cavity proximate the first section. The light emitting element is movably mounted within the reflector. The focusing mechanism includes a rotatable band disposed around the housing and a means for moving the light emitting element, relative to the reflector, in response to rotational movement of the rotatable band. The rotatable band is connected through the housing to the means for moving the light emitting element.

The present invention also relates to a flashlight that is capable of producing different size light patterns. The flashlight includes a tubularly shaped housing, a reflector, a light and a focusing assembly. The housing, which defines an enclosed cavity, has an exterior surface, a first end and a second end. The first end defines an opening having a light transparent material disposed there across. The reflector is secured within the cavity adjacent the opening in the housing's first end. The light is located within the reflector. The focusing assembly includes a circular, rotatable ring disposed around the exterior of the housing. The rotatable ring contacts a carrier and holder subassembly through the housing. The subassembly moves laterally within the housing in response to rotational movement of the rotatable ring. The subassembly causes the light to move laterally within the reflector thereby altering the size of the light patterns produced by the flashlight.

DETAILED DESCRIPTION OF THE INVENTION

Figure 1:
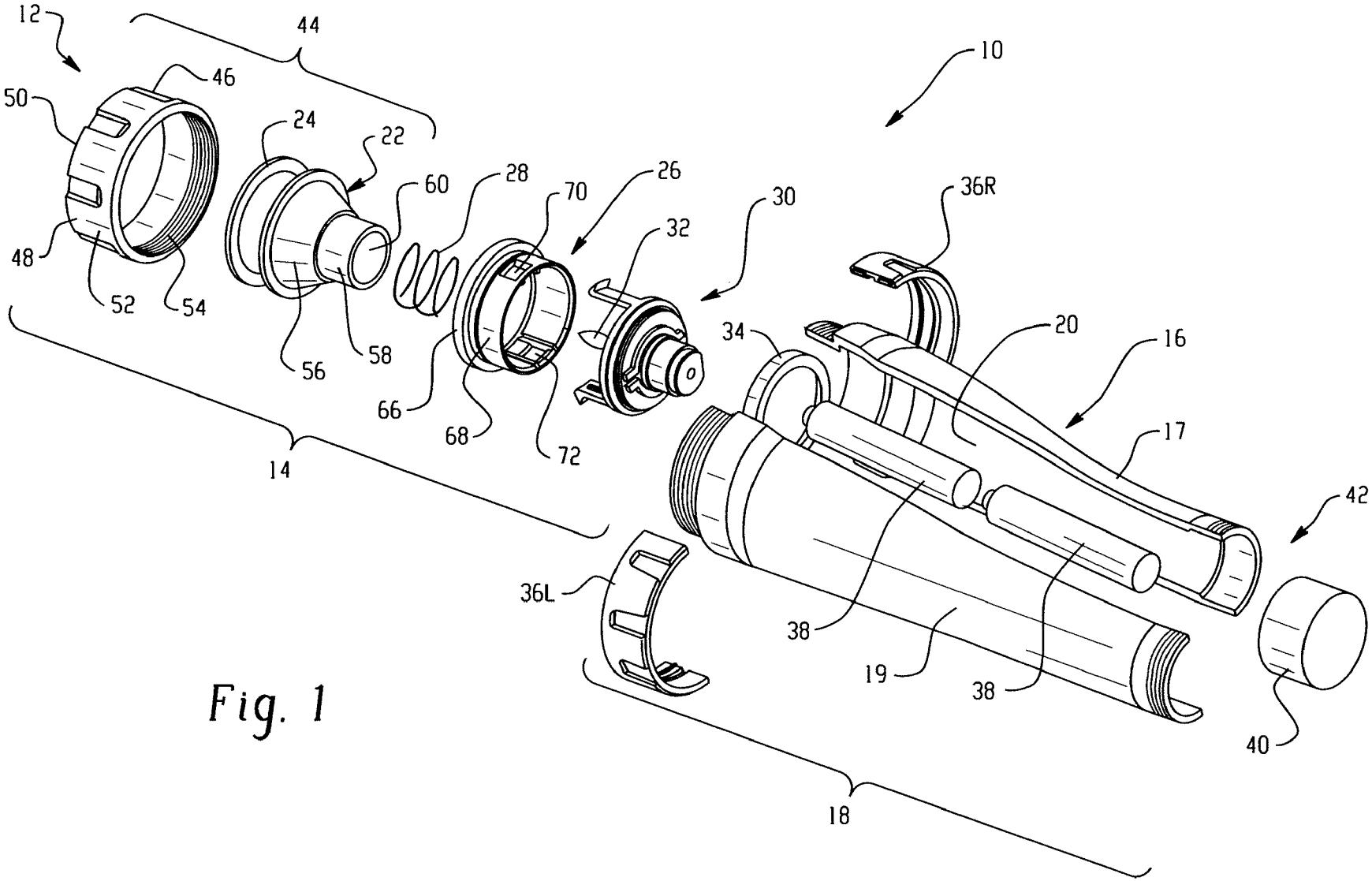
FIG. 1 is an exploded perspective view of a portable lighting device of this invention.

Shown in FIG. 1 is an exploded perspective view of a portable lighting device 10 of this invention which is referred to herein as a flashlight. In this embodiment, the following components are secured to one another. The lighting device's housing includes the outer surfaces of lens cap 42, body housing 16 and end cap 40. Body housing 16 comprises right side body housing 17 and left side body housing 19. Beginning at a first end 12 of the flashlight is a lens cap assembly which is also identified herein as first section 14. The lens cap assembly is removably secured to second section 18. When first section 14 is secured to second section 18, cavity 20 (see FIG. 7) is defined therein. The location at which the first section is secured to the second section may be referred to herein as a junction. Contained within the cavity is reflector 22. The reflector contacts lens 24, retaining member 26 and coiled spring 28. Light holder carrier 30 movably and removably engages retaining member 26 which, in an assembled flashlight, is secured to reflector 22. Light emitting element 32 is located within the bulb holder 31 which is secured to the light holder carrier. Adjustable carrier 34 contacts the light holder carrier and extends through opening 144 (see FIG. 5) in right side body housing 17 thereby engaging the rotatable, focusing ring 36R. Also contained within the cavity are two batteries 38 that provide a source of electrical energy. The batteries are electrically connected to the light emitting element through an electrical circuit that includes an on/off switch (not shown). End cap 40 is secured to the second end 42 of body housing 16.

As shown in FIG. 1, lens assembly 44 includes lens cap 46 and lens 24. Lens cap 46 has a base 48 that defines opening 50 therethrough, and a circular sidewall 52 that depends from the base. The interior surface 54 of sidewall 52 is threaded to facilitate a threaded engagement with second section 18. Lens 24 is a generally flat transparent disc that fits within the lens cap and covers the opening in the lens cap. Reflector 22 abuts lens 24 near the perimeter of the lens. Reflector 22 includes a generally cone shaped portion 56 that abuts tubular portion 58 which defines a centrally located opening 60. Coiled spring 28 contacts an outer surface of cone shaped portion 56 of reflector 22. The inside diameter of coiled spring 28 is slightly larger than the outside diameter of the reflector's tubular portion 58 thereby allowing the spring to easily fit over and around the reflector's tubular portion. Retaining member 26 has a base 66 from which sidewall 68 depends. In an assembled flashlight, retaining member 26 is permanently secured to the reflector. Sidewall 68 defines rectangular openings 70 and 72 therein. The openings are 180° apart.

Figure 2:
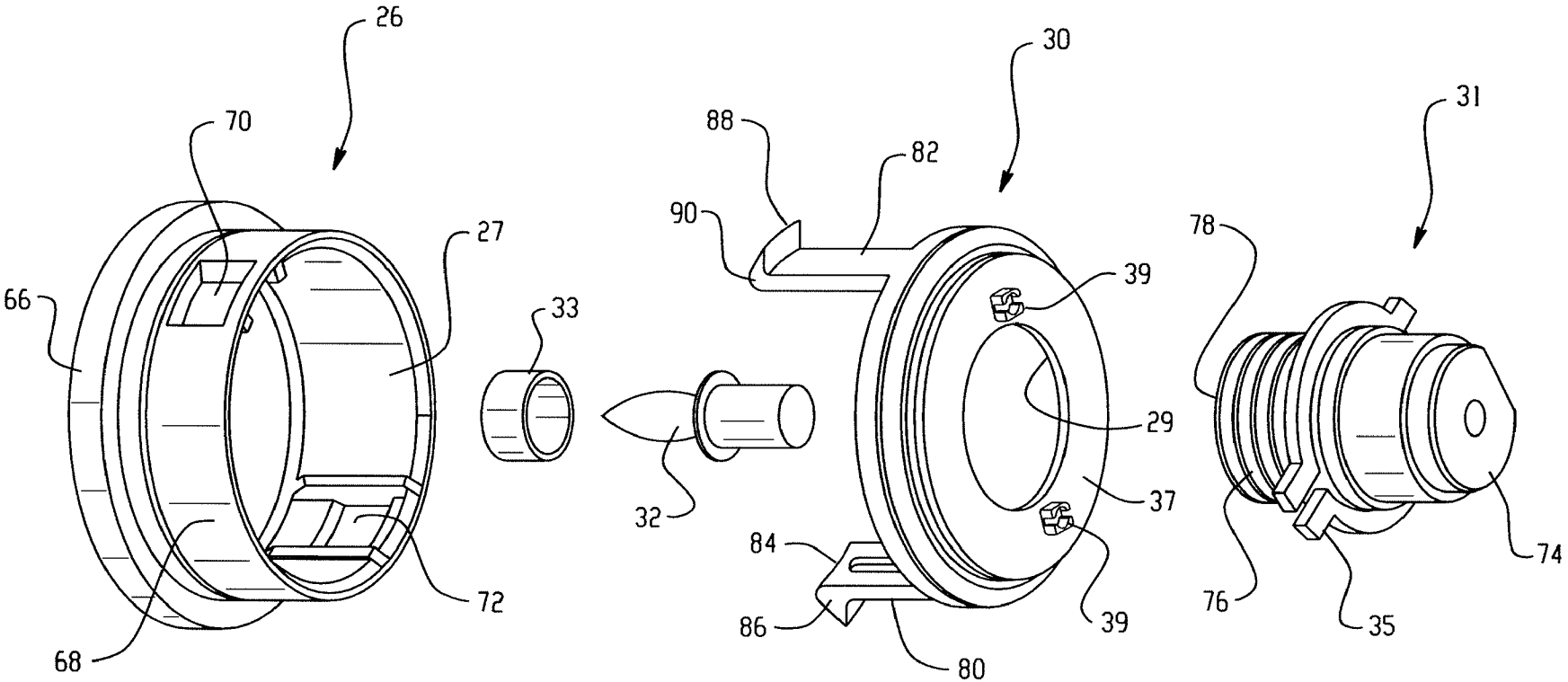
FIG. 2 is a perspective view of a portion of a focusing mechanism used in a lighting device of this invention.

Referring now to FIG. 2, the features of retaining cap 33, light emitting element 32, light holder carrier 30 and bulb holder 31 will now be described. Bulb holder 31 includes a base 74, a circular wall 76 depending perpendicularly from the base and defining cavity 78 therein. Bulb holder 31 includes a snap fit connector 35 that facilitates securely attaching bulb holder 31 to the light holder carrier by forcing snap fit connector 35 into interference fit with detents 39 that are located on the base 37 of light holder carrier 30. Light holder carrier 30 includes first projection arm 80 and second projection arm 82 that extend perpendicularly from base 37 and parallel to one another. The first projection arm 80 has a distal end 84 with a locking structure 86 formed at distal end 84. The second projection arm 82 has a distal end 88 with a locking structure 90 formed at distal end 88. The width and length of each projection arm's distal end and the width and height of openings 70 and 72 defined by the retaining member and with which the distal end will be engaged are coordinated to insure that the distal end of each projection arm, including the locking structure, will readily fit within one of the retaining member's openings. Each locking structure must be able to easily move toward and away from the reflector. The distance which the projection arms can travel is determined by the height of the openings in the retaining member. Retaining cap 33 is a generally cap shaped component with a tubular upstanding wall that abuts a base which defines an opening therethrough. The interior surface of the upstanding wall is threaded. The light emitting element may be an incandescent bulb, a light emitting diode or a fluorescent bulb.

The components shown in FIG. 2 may be assembled as follows. Lamp holder 31 is partially inserted through the opening 29 in base 37 of light holder carrier 30 until snap fit connector 35 abuts the base of the light holder carrier. The snap fit connector is made to forcefully engage detents 39 thereby securing the bulb holder and light carrier to one another. Light emitting element 32 is then inserted into cavity 78. Retaining cap 33 is then threaded onto matching threads located on the exterior surface of the bulb holder's circular wall 76. The retaining cap is designed to allow the light generating portion of the light emitting element to project through the retaining cap while simultaneously securing the light emitting element to the bulb holder. The light holder carrier with the light emitting element and bulb holder secured thereto is then made to engage retaining member 26 by forcing the distal ends of projection arms 80 and 82 to flex toward each other as they contact and slide along the interior surface of retaining member 26 until locking structures 86 and 90 spring outwardly through openings 70 and 72 thereby establishing an interlocking relationship between the light holder carrier and the retaining member. Because the locking structures are narrower than the width of the openings and shorter than the height of the openings, the light holder carrier can easily move toward and away from the base of the retaining member.

Figure 3A:
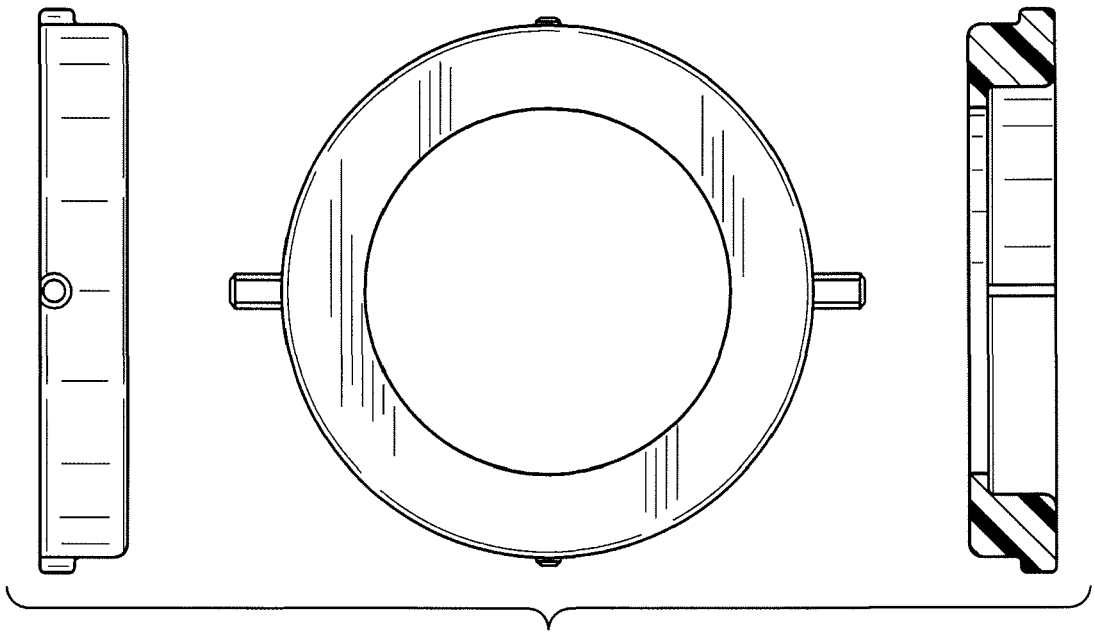
FIGS. 3A, 3B and 3C are three views of an adjustable carrier that is suitable for use in a portable lighting device of this invention.
Figure 3B:
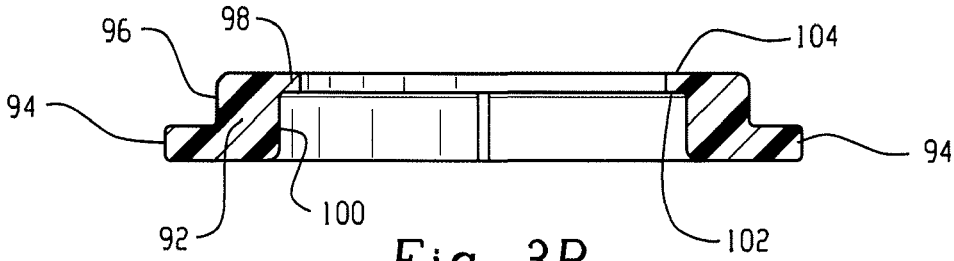
Figure 3C:
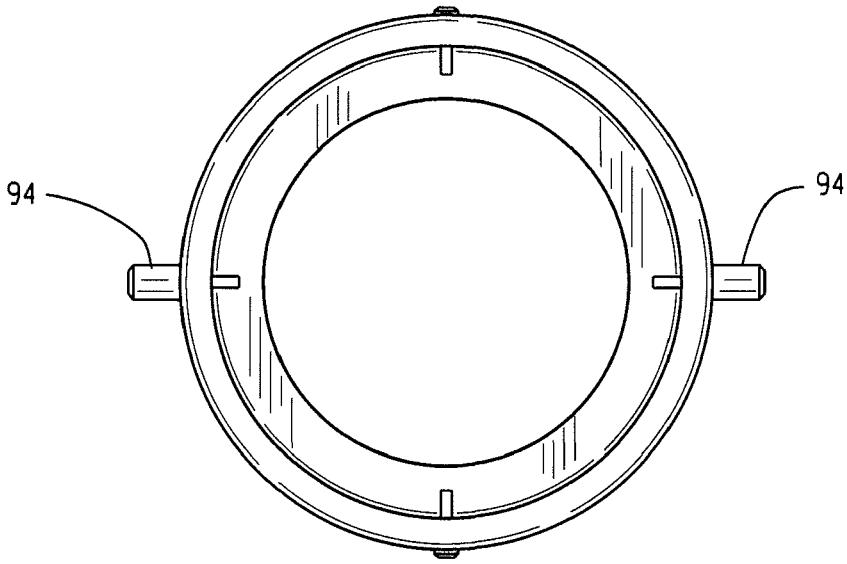

As shown in FIGS. 3A, 3B and 3C, adjustable carrier 34 is a circular component with a vertical wall 92 having two projections 94 protruding outwardly and perpendicularly from an outer circumferential edge 96 of the vertical wall and a flange 98 projecting inwardly and perpendicularly from an inner circumferential second edge 100 of the vertical wall. Depending flange 98 has an inner surface 102 that abuts base 104 of light holder carrier 30 when the light is assembled.

Figure 4A:
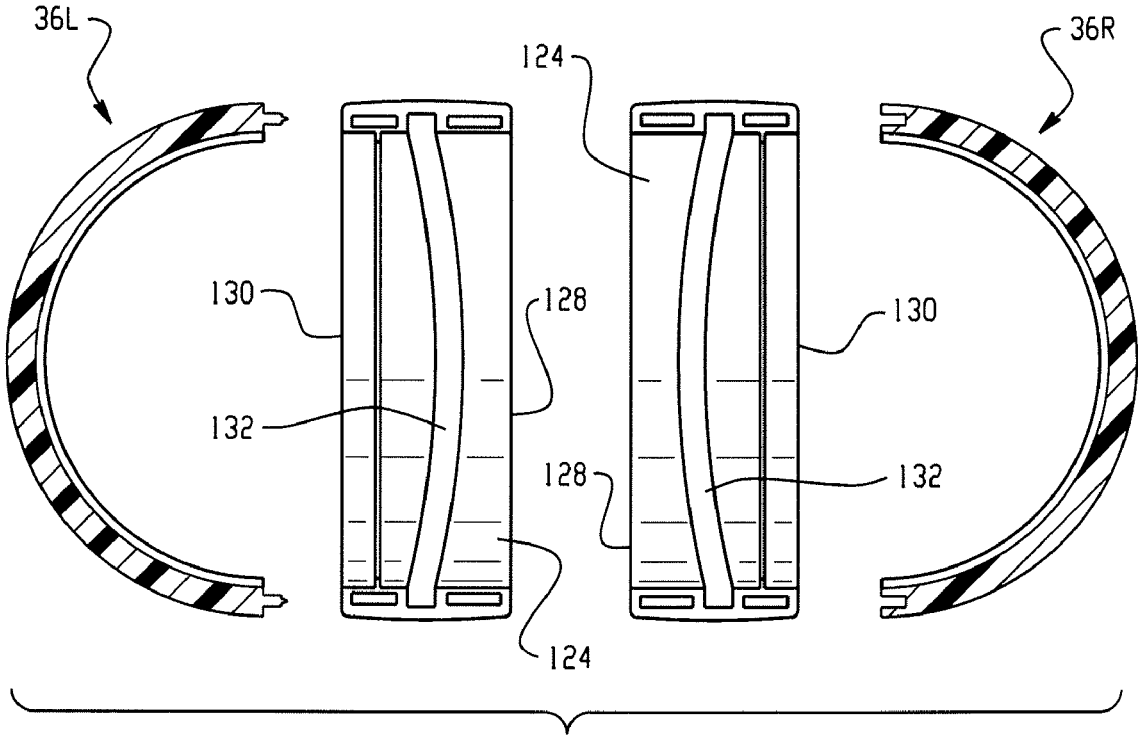
FIG. 4A shows side views and cross-sectional views of a focusing ring.
Figure 4B:
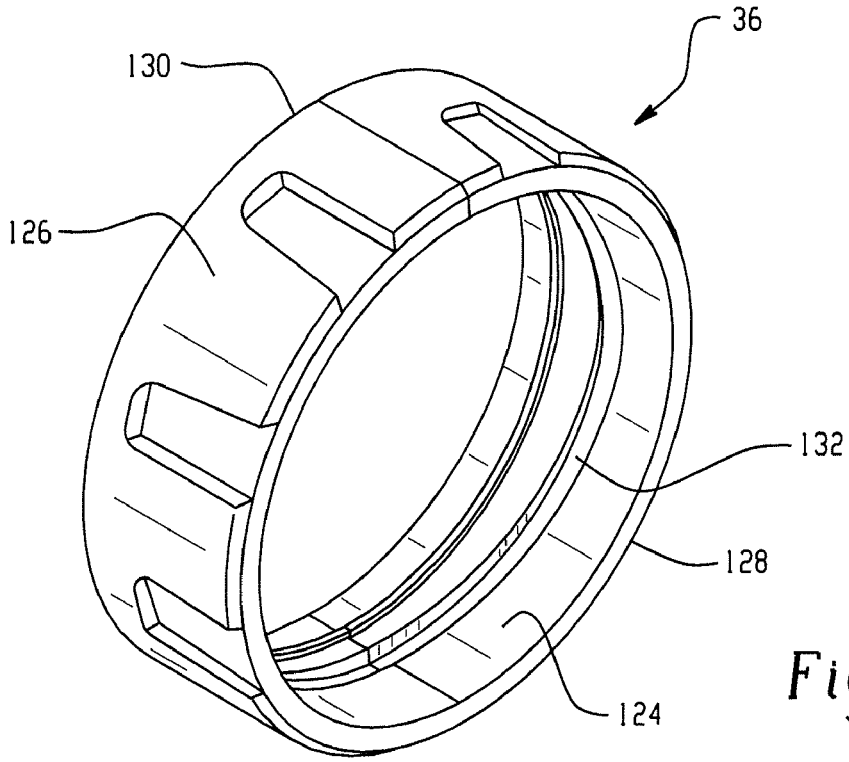
FIG. 4B shows a perspective view of a complete focusing ring.

As shown in FIG. 4A, rotatable ring 36 is made from a right half ring 36R and a left half ring 36L. As shown in FIG. 4B, when half rings 36R and 36L are secured to one another, complete ring 36 is formed. Complete ring 36 may also be referred to herein as a focusing ring, rotatable ring or rotatable band. A groove 132 is formed in the surface of each half ring. The physical dimensions of the grooves in 36R and 36L are identical. In order to form a continuous undulating groove in the inner surface of the focusing ring, the groove in half ring 36L must be a mirror image of the groove in half ring 36L. Focusing ring 36 has an interior surface 124, an exterior surface 126, a first edge 128 and a second edge 130. Groove 132 is formed in the interior surface. The middle of groove 132 is closest to first edge 128 and the ends of groove 132 are closest to and equal distance from the second edge 130. Due to the continuous undulating groove formed on the interior surface of the focusing ring, the width of the projected light pattern can be continuously adjusted by rotating the focusing ring an infinite number of times in either a first (clockwise) direction or a second (counterclockwise) direction. Because rotation of the focusing ring does not loosen the connection between the lens cap and the flashlight's body housing, there is no need to limit the direction nor degree of rotation that the focusing ring can be rotated. If desired, the exterior surface 126 of rotatable ring 36 can be decorated with indicia, such as numbers or letters that will allow the user to preset the light's pattern before using the flashlight's switch to complete the electrical circuit thereby providing power to the light emitting element. Each number or letter can be made to correspond to a different position between the light emitting element and the reflector. Furthermore, the exterior surface of the focusing ring may be covered with an outer sleeve (not shown) that will improve the consumer's ability to easily grasp and rotate the focusing ring. The outer sleeve may be made from a pliable material such as a soft rubber.

Figure 5:
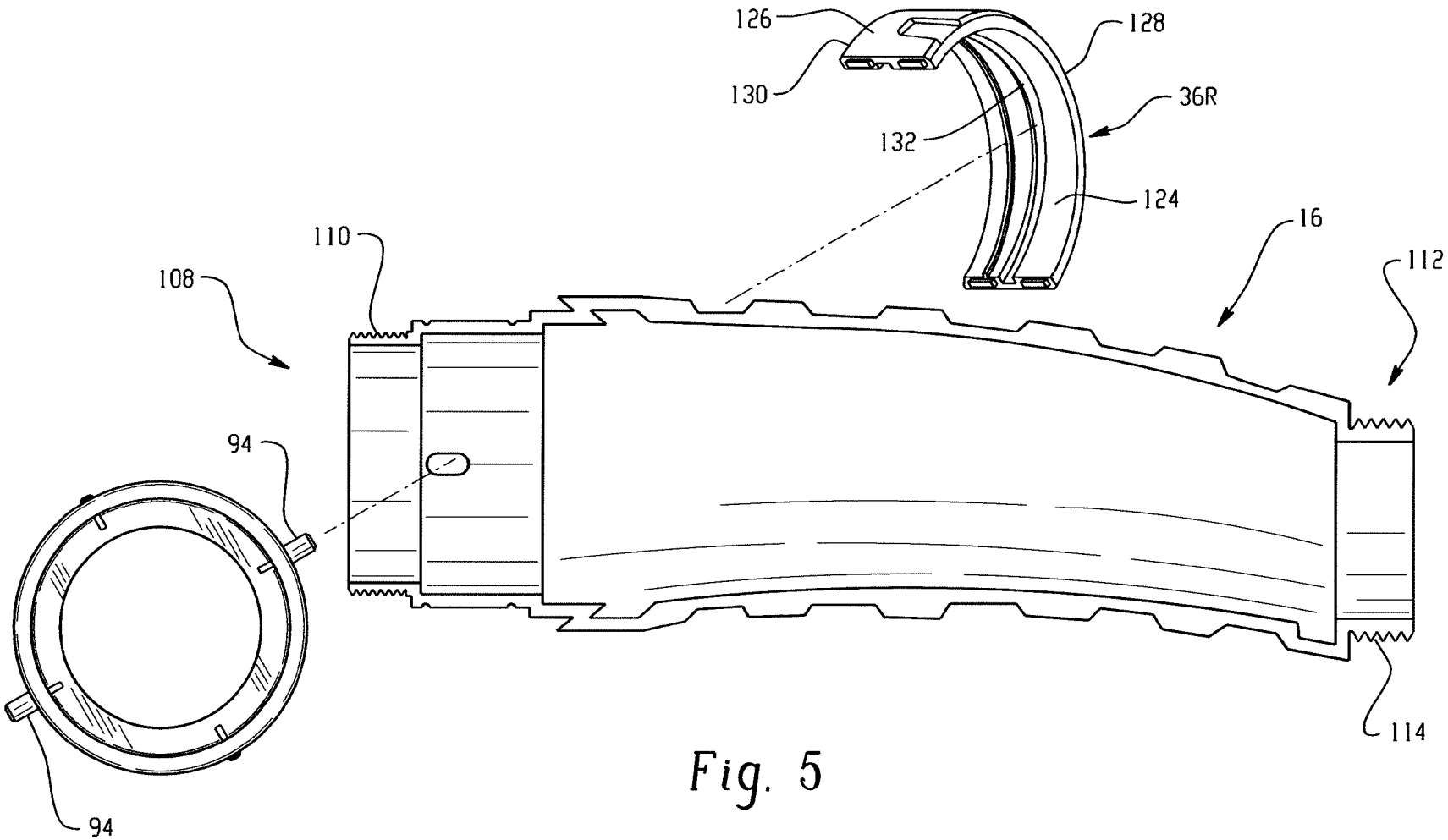
FIG. 5 is a cross-section showing an adjustable carrier, a cross section of a body housing and a focusing ring.

Shown in FIG. 5 is a cross section of right body housing 17. Located at the first end 108 of right body housing 17 are threads 110 that are used to secure the body housing to lens cap 46 thereby forming a junction between the lens cap and body housing. Located at the second end 112 of body assembly 16 are threads 114 that are used to secure end cap 40 to the body assembly.

Figure 6:
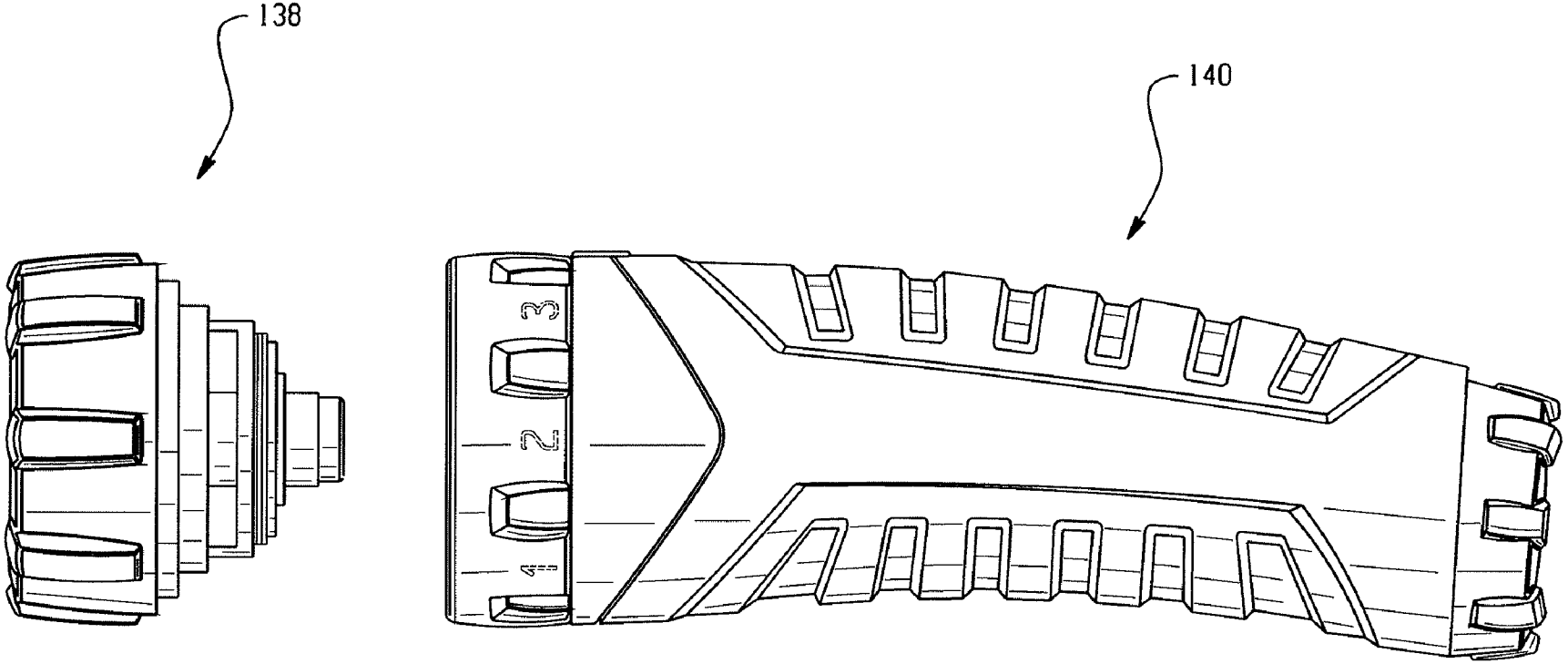
FIG. 6 shows a partially disassembled flashlight of the present invention.

FIG. 6 shows a flashlight of this invention that has been partially disassembled to facilitate replacement of the batteries. In this view, top assembly 138 has been separated from bottom assembly 140 by rotating the top assembly while holding the lower assembly stationary thereby loosening the threaded connection therebetween. The top assembly includes: lens cap, lens, reflector, coiled spring, retaining member, light holder carrier and light emitting element. The bottom assembly includes: batteries, focusing ring, adjustable carrier, body housing and end cap. After the top assembly has been separated from the bottom assembly, the depleted batteries can be removed from the flashlight's cavity and replaced with new batteries. Due to the construction of the flashlight, focusing ring 36 does not need to be rotated during the battery replacement process. Consequently, the batteries can be replaced without adjusting the width of the beam projected by the flashlight. If the consumer has preset the flashlight's focus to provide optimum illumination during a specific activity, and the batteries suddenly stop functioning, the consumer can rapidly replace the batteries without needing to reset the focus before once again using the flashlight.

Figure 7:
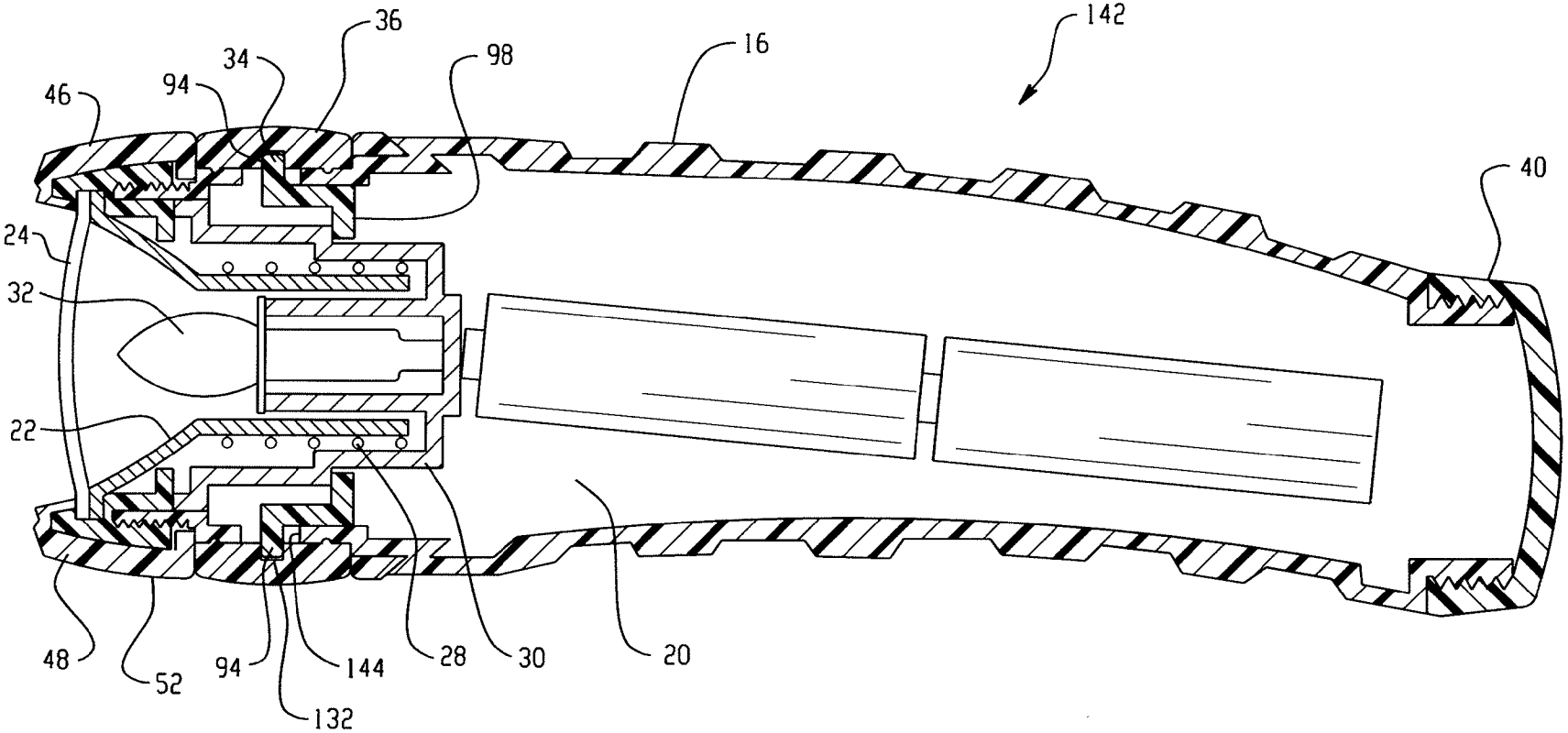
FIG. 7 is a cross-section of an assembled flashlight of this invention.

The operation of an assembled flashlight of this invention will now be explained. Assembled flashlight 142, shown in FIG. 7, can be made to project different size light patterns onto a flat surface located a fixed distance from the flashlight by rotating focusing ring 36 around the perimeter of housing 16. The rotational movement of ring 36 causes relative movement between reflector 22 and the light emitting element 32 by moving the light emitting element within the reflector that is securely positioned in the housing. The rotational movement of the ring is converted into linear movement by the focusing assembly which includes a focusing ring and a means for moving light emitting element 32. The means for moving the light emitting element includes a means for holding a light emitting element, a resilient means and a carrier means. In FIG. 7, the resilient means is coiled spring 28 that is compressed and trapped between reflector 22 and light holder carrier 30. The function of the resilient means is to push the light holder assembly away from the reflector. Other resilient means could include leaf springs or elastomeric components that are configured to constantly displace the light holder carrier away from the reflector. The carrier means disclosed in FIG. 7 is adjustable carrier 34 which simultaneously contacts focusing ring 36 and light holder carrier 30. In the embodiment shown in FIG. 7, the carrier's projections 94 protrude through openings 144 in body housing 16 and engage spiral groove 132 in the interior surface of the focusing ring by fitting within the width of groove 132. The adjustable carrier's flange 98 contacts and supports the base of the light holder carrier thereby counteracting and limiting the coiled spring's ability to force the light holder carrier away from the reflector. While the adjustable carrier embodiment shown in FIGS. 3A, 3B and 3C disclose a wall 92 with two projections 94 and flange 98 depending from the wall, carrier means having other physical configurations are possible provided the carrier means converts rotary movement around the housing to lateral movement within the housing.

The means for holding a light emitting element includes light holder carrier 30 and retaining member 26. The means for holding a light emitting element is assembled by inserting the distal ends, 84 and 88, of the holder's projecting arms, 80 and 82, inside the retaining member's sidewall 64 so that locking structures 86 and 90 forcefully engage openings 70 and 72 by extending partially into and through the openings in the sidewall. The projecting arms are made from a sufficiently flexible material that the arms can be squeezed together to enable insertion of the arms inside the retaining member and the arms will spring back through the openings thereby removeably securing the light holder carrier to the retaining member which is rigidly attached to the reflector that is secured to the housing. The openings in the retaining member are sized to allow the light holder carrier to move linearly toward and away from the reflector to which the retaining member is secured. The linear movement of the light holder carrier, which is also described herein as backward and forward movement of the light holder carrier, results in the light emitting element moving into and out of the reflector's optimum point of focus which causes the width of the flashlight's projected light pattern to change from narrow to broad or from broad to narrow.

When the flashlight is assembled, the adjustable carrier's projections 94 are made to align with and project through two opposing openings 144 in housing 16 thereby enabling the projections to extend into and engage the spiral groove in the focusing ring. When the user rotates the focusing ring around the housing, the spiral groove forces the carrier to move back and forth within the housing. Because the adjustable carrier's inwardly depending flange 98 abuts the base of the light carrier holder, a first rotational movement of the rotatable ring forces the light emitting element to move laterally within the housing toward the reflector. When the rotatable ring is rotated further in the first direction or in a second direction that is opposite to the first direction, the adjustable carrier moves away from the reflector thereby allowing the coiled spring to forcefully bias the holder away from the reflector. As the light emitting element moves within the reflector, the flashlight's projected pattern of light varies from narrow to broad and from broad to narrow. Due to the flashlight's unique design, adjusting the light to provide a broad or narrow pattern of light does not loosen the lens cap from the body housing thereby eliminating the possibility that the flashlight's components may be suddenly and unexpectedly separated from one another.

The above description is considered that of the preferred embodiments only. Modifications of the invention will occur to those skilled in the art and to those who make or use the invention. Therefore, it is understood that the embodiments shown in the drawings and described above are merely for illustrative purposes and are not intended to limit the scope of the invention, which is defined by the following claims as interpreted according to the principles of patent law, including the Doctrine of Equivalents.

We claim:

1. A portable lighting device, comprising:

a housing;

a light emitting element within the housing; and a rotatable band disposed around the housing, wherein rotation of the rotatable band in one direction provides a projected pattern of light emitted by the light emitting element that oscillates from narrow to broad and broad to narrow.

2. The device of claim 1, further comprising a carrier mechanism disposed within the housing for moving the light emitting element in response to rotational movement of the rotatable band.

3. The device of claim 2, wherein the carrier mechanism comprises one or more projections that extend through one or more openings in the housing and contact the rotatable band.

4. The device of claim 1, further comprising a reflector disposed within the housing and a lens assembly attached to the housing and in contact with the reflector.

5. The device of claim 1, further comprising a resilient mechanism that pushes the light emitting element away from the reflector.

6. The device of claim 5 wherein the resilient mechanism comprises elastomeric components that displace the light emitting element away from the reflector.

7. The device of claim 2, wherein the rotatable band comprises a groove in an interior surface, wherein the groove interacts with the mechanism.

8. The device of claim 7, wherein the groove is a spiral groove.

9. The device of claim 1, wherein the rotatable band causes the light emitted by the light emitting element to be out of focus.

10. The device of claim 1, further comprising at least one battery disposed within the housing.

11. The device of claim 1, wherein the light emitting element is comprised of at least one light emitting diode.

12. A portable lighting device, comprising:

a housing;

a light emitting element;

a light holder movably mounted within the reflector that holds the light emitting element;

a focusing assembly comprising a rotatable band disposed around the housing and a carrier disposed within the housing for moving the light holder in response to rotational movement of the rotatable band, the rotatable band coupled to the carrier through the housing, wherein rotation of the rotatable band in one direction provides a projected pattern of light emitted by the light emitting element that oscillates from at least one of narrow to broad and broad to narrow.

13. The device of claim 12, wherein the light holder comprises a base and a locking mechanism.

14. The device of claim 12, wherein an outer surface of the rotating band comprises indicia indicating the projected pattern of light.

15. The device of claim 12, wherein the housing is tubular shaped.

16. The device of claim 12, further comprising a reflector.

17. A method of operating a portable lighting device, the method comprising:

providing a housing having a light emitting element and a rotatable band on an outer surface of the housing; and rotating the rotatable band in a first direction to widen a light pattern of light emitted by the light emitting element; and continuing to rotate the rotatable band in the first direction to narrow the light pattern of the light emitted by the light emitting element.

18. The method of claim 17, further comprising moving the light emitting element in response to rotating the rotatable band.

19. The method of claim 18, wherein moving the light emitting element comprises moving a carrier mechanism holding the lighting element.

20. The method of claim 17, further comprising rotating the rotatable band in a second direction opposite the first direction and widening the light pattern of the light emitted by the light emitting element.

* * * * *